US005975066A

United States Patent [19]

Morikami

[11] Patent Number: 5,975,066

[45] Date of Patent: Nov. 2, 1999

[54] METHOD AND SYSTEM FOR CONTROLLING ENGINE AIR-FUEL RATIO

[75] Inventor: Tadaaki Morikami, Hamamatsu, Japan

[73] Assignee: Suzuki Kabushiki Kaisha, Hamamatsu, Japan

[21] Appl. No.: 09/039,631

[22] Filed: Mar. 16, 1998

[30] Foreign Application Priority Data

Mar. 17, 1997 [JP] Japan ..... 9-063045

[51] Int. Cl.[6] ..... F02D 41/14

[52] U.S. Cl. ..... 123/674; 701/103

[58] Field of Search ..... 123/687, 674, 123/675; 701/103, 104

[56] References Cited

U.S. PATENT DOCUMENTS 4,748,956 6/1988 Iwaki ..... 123/675
5,024,199 6/1991 Abe ..... 123/674
5,099,817 3/1992 Nakaniwa ..... 123/674
5,743,244 4/1998 Bush et al. ..... 123/674

*Primary Examiner*—Tony M. Argenbright
*Assistant Examiner*—Arnou Castro
*Attorney, Agent, or Firm*—Finnegan, Henderson, Farabow, Garrett & Dunner, L.L.P.

[57] ABSTRACT

An air-fuel ratio in an engine provided with an air-fuel ratio control unit is controlled, by using an oxygen sensor disposed in an exhaust gas passage in operative association with the air-fuel ratio control unit, by the steps of setting a feedback control mode for detecting states of the exhaust gas by using the oxygen sensor, operating the engine in one of a plurality of operating areas which are sectioned in accordance with an engine operational conditions such as engine revolution speed, determining a correction value of the air-fuel ratio in accordance with the engine operation with respect to a set value, and calculating another correction value of the air-fuel ratio in another operating area on the basis of the correction value previously determined.

12 Claims, 8 Drawing Sheets

METHOD AND SYSTEM FOR CONTROLLING ENGINE AIR-FUEL RATIO

BACKGROUND OF THE INVENTION

The present invention relates to method and system for controlling an engine air-fuel ratio.

An engine of an outboard motor, for example, degrades as time passes, and consequently, a state or condition of an exhaust gas from the engine gets worse and at the same time, drivability thereof, such as acceleration, also gets worse. Therefore, it has been required for the engine to perform a feedback control to monitor the state of the exhaust gas, by using an oxygen ($O_2$) sensor or the like. The fuel injection quantity or the like is their changed according to the operating state of the engine to thereby control the air-fuel ratio, so that the exhaust gas state and the drivability of the engine may be kept in a good condition.

However, for example, in an engine used for an outboard motor, there is a possibility that the sea water may enter an exhaust gas passage to which the oxygen ($O_2$) sensor is usually mounted. In such a situation it is difficult or impossible to use an $\mathbf{0}_2$ sensor, and the feedback control may also become difficult or impossible.

Furthermore, in a case where an engine is used for an automobile, although it is possible to use an $O_2$ sensor, the durability and reliability of the engine cannot be ensured in consideration of the degradation, variation in detecting capability, accuracy or the like of the sensor. Especially, in the high operational speed range of the engine, in order to keep the drivability thereof in a good condition, the term of an output air-fuel ratio is usually used as the air fuel ratio rather than the term of the theoretical air-fuel ratio, and therefore, it is impossible to suitably perform the feedback control mentioned above.

Furthermore, it has resulted in cost-up that an $O_2$ sensor is provided for an engine at all times.

SUMMARY OF THE INVENTION

An object of the present invention is to substantially eliminate defects or drawbacks encountered in the prior art described above and to provide a method and system for controlling an air-fuel ratio of an engine for keeping a proper air-fuel ratio while preventing degradation of an oxygen sensor disposed therefor.

This and other objects of the present invention can be achieved by providing a method of controlling an air-fuel ratio in an engine provided with an air-fuel ratio control means, including the steps of:

temporarily attaching an oxygen sensor to a sensor mounting positioned in an exhaust gas passage formed in the engine in operative association with the air-fuel ratio control means wherein the sensor mounting acts as a feedback mode shift switch, the feedback mode switching to "ON" when the oxygen sensor is attached to the sensor mounting and switching to "OFF" when the oxygen sensor is detached from the sensor mounting;

setting a feedback control mode for detecting states of the exhaust gas by using the oxygen sensor;

operating the engine in one of a plurality of operating areas which are sectioned in accordance with engine operational conditions such as engine revolution speed and engine intake load;

determining a first correction value of the air-fuel ratio in accordance with the engine operation with respect to a preliminary set value; and calculating a second correction value of the air-fuel ratio in another operating area on the basis of the first correction value determined.

In preferred modes, a revolution speed set in accordance with the operating area is determined by an operable engine revolution speed. An air-fuel ratio map is prepared at respective operating areas at the time of the engine feedback control and a value of the air-fuel ratio map is temporarily set to be theoretical air-fuel ratio at the time of the feedback control.

The feedback control mode begins it is determined when that the oxygen sensor is normally operated, the correction value may be concerned with a fuel injection amount which is determined by the engine operational condition.

In another aspect of the present invention, there is provided a system for controlling an air-fuel ratio in an engine including:

an air-fuel ratio control means disposed in association with the engine;

an oxygen sensor removably attached to a sensor mounting disposed in an exhaust gas passage formed in the engine in operative association with the air-fuel ratio control means;

means for setting a feedback control mode for detecting states of the exhaust gas by using the oxygen sensor;

means for operating the engine in one of a plurality of operating areas which are sectioned in accordance with an engine operational conditions such as engine revolution speed or intake load;

means for determining a first correction value of the air-fuel ratio in accordance with the engine operation with respect to a preliminary set value; and means for calculating a second correction value of the air-fuel ratio in another operating area on the basis of the first correction value calculated by the correction value determining means.

According to the characters of the present invention mentioned above, the feedback control mode for detecting the state of exhaust gas by using the oxygen sensor is set, and correction values of the air fuel ratio are determined by operating the engine in a part of areas of a plurality of operating areas divided in accordance with the revolution speed, the loads and the like of the engine. On the basis of the correction values, correction values of the air-fuel ratio in other operating areas are calculated, and consequently, a proper air-fuel ratio can be kept while preventing the degradation of the oxygen sensor. Thus, the accuracy in correction of the air-fuel ratio is improved.

Furthermore, since the value of the air-fuel ratio map in each operating area is set to be temporarily the theoretical air-fuel ratio at the time of feedback control of the engine, the initially set air-fuel ratio map can be used at the time of normal operation.

The nature and further characteristic features of the present invention will be clarified from the following descriptions made with reference to the accompanying drawings.

DESCRIPTION OF THE PREFERRED EMBODIMENTS

The preferred embodiments of the present invention will be described hereunder with reference to the accompanying drawings.

Figure 1:
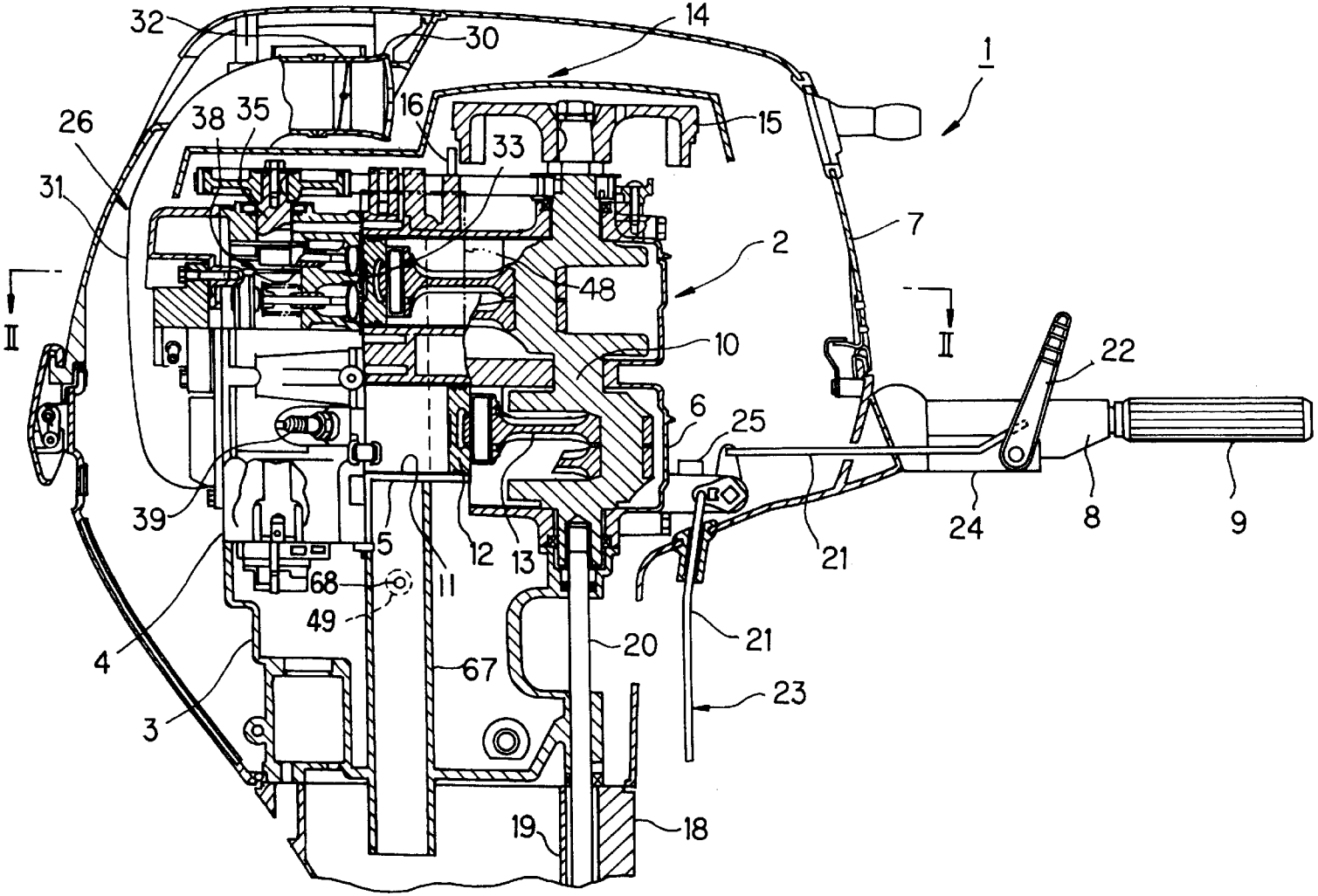
FIG. 1 is an elevational section of an upper portion of an outboard motor for the explanation of one embodiment of an air-fuel ratio control method of an engine according to the present invention.
Figure 2:
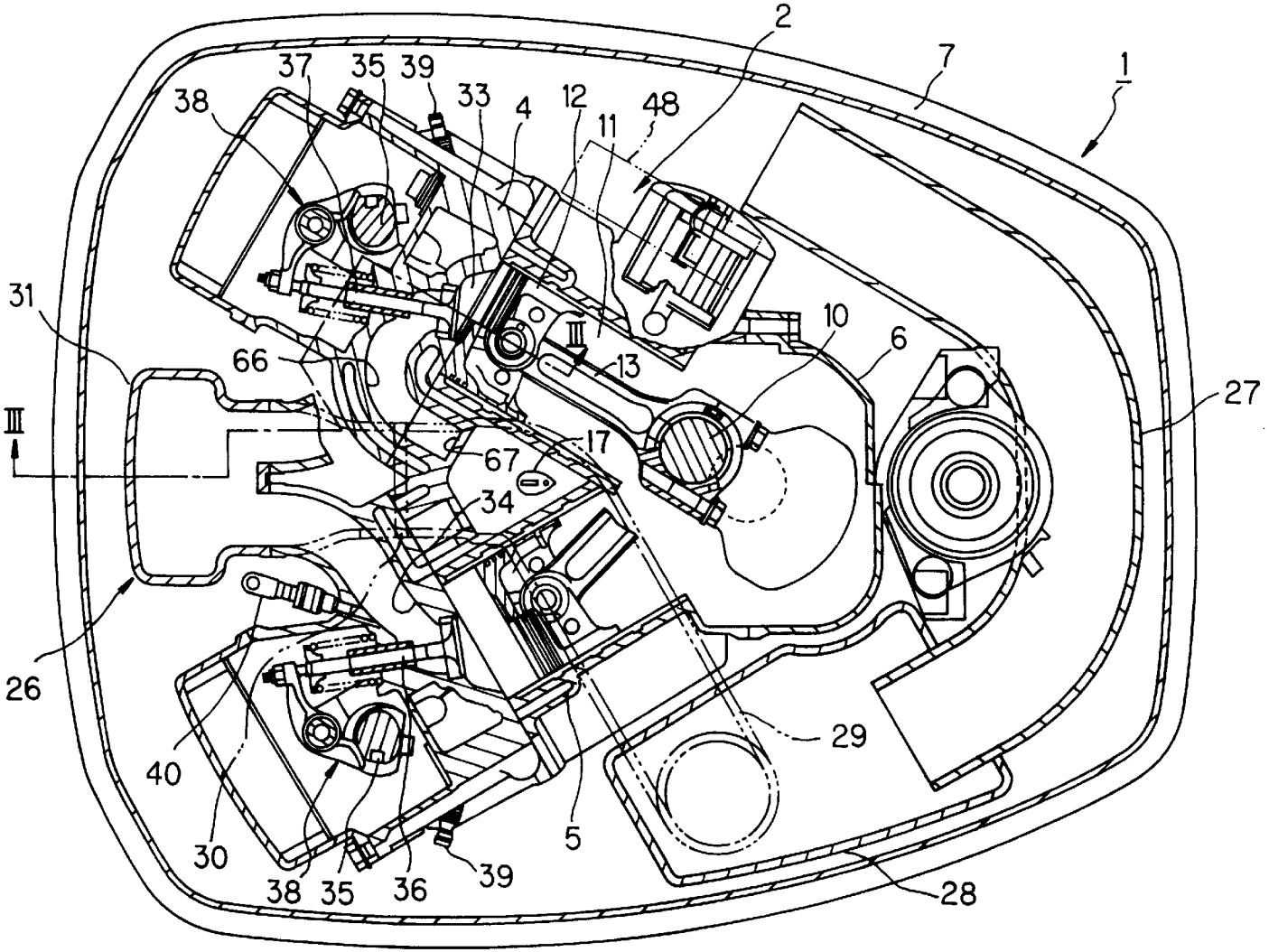
FIG. 2 is a cross-sectional view taken along the line II—II in FIG. 1.

Referring to FIGS. 1 and 2 showing an outboard motor to which the present invention is applicable, an engine 2 of an outboard motor 1 is, for example, a water cooled four-stroke-cycle V-type four-cylinder engine, and is mounted to an engine holder 3. The engine 2 is composed by combining a cylinder head 4, a cylinder block 5, a crank case 6 and so on, and further, an outer periphery and the upper portion thereof are covered by an engine cover 7. From the front potion (right side in FIG. 1) of the engine cover 7, a steering handle 8 is extending forward, and to the tip thereof, a throttle grip 9 for controlling engine output (power) is mounted.

In the crank case 6 of the engine 2, a crank shaft 10 is pivotally supported, and in the cylinder block 5, a cylinder 11 is formed. A piston 12 is slidably inserted in the cylinder 11 at the right angle to the crank shaft 10, and the piston 12 and the crank shaft 10 are connected through a connecting rod 13 so as to convert the reciprocal stroke of the piston 12 to the rotational motion of the crank shaft 10. Furthermore, to an upper end of the crank shaft 10, a magnet device 14 including, for example, a fly wheel magnet 15, is mounted, and a crank angle sensor 16 for detecting the rotational angle of the crank shaft 10 is installed at a portion near the periphery of the fly wheel magnet 15. Further, an engine temperature sensor 17 for detecting the wall temperature of the engine 2 is provided for the cylinder block 5.

On the other hand, to the lower portion of the engine holder 3, a drive shaft housing 18 is provided, and a gear case, not shown in the figure, is provided to a lower portion of the drive shaft housing 18. In the gear case, a propeller shaft, not shown, is pivotally supported, and at the rear end thereof, a propeller, not shown, is mounted.

A shaft pipe 19 is arranged in the drive shaft housing 18, and a drive shaft 20 is connected to the lower end portion of the crank shaft 10 so as to extend downward in the shaft pipe 19. The lower end of the drive shaft 20 is connected to the propeller shaft through a clutch mechanism, not shown. An output of the engine 2 is transmitted to the propeller shaft through the drive shaft 20 and the clutch mechanism.

Furthermore, a clutch device 23 is provided for the engine 2 for remotely controlling the clutch mechanism by a clutch control lever 22 connected through a clutch control rod 21 and changing the rotational direction of the propeller shaft and the propeller through shifting operation of the clutch mechanism.

The clutch control lever 22 of the clutch device 23 is pivotally mounted to a stay 24 projecting from the engine cover 7 to the front side of the engine 2. Then, by turning the clutch control lever 22 back and forth, the clutch mechanism is subjected to the shift operation through the clutch control rod 21, and the rotational direction of the propeller shaft and the propeller is shifted to the forward direction, the reverse direction, or the neutral. Further, a shift position sensor 25 for detecting the shift position thereof is also mounted to the clutch device 23.

The engine 2 is equipped with an air intake device 26, which is composed of an intake pipe 27, a silencer 28, a connecting tube 29, a throttle body 30, and a surge tank 31. The intake pipe 27 is a pipe for introducing fresh air from the outside into the engine, and the silencer 28 is a device for reducing an intake noise and pulsation of the air. Furthermore, the throttle body 30 has a throttle valve 32 installed therein for controlling the flow rate of the intake air. The throttle body 30 and the silencer 28 are connected through the connecting tube 29, and on the down stream side of the throttle body 30, the surge tank 31 is connected.

Figure 3:
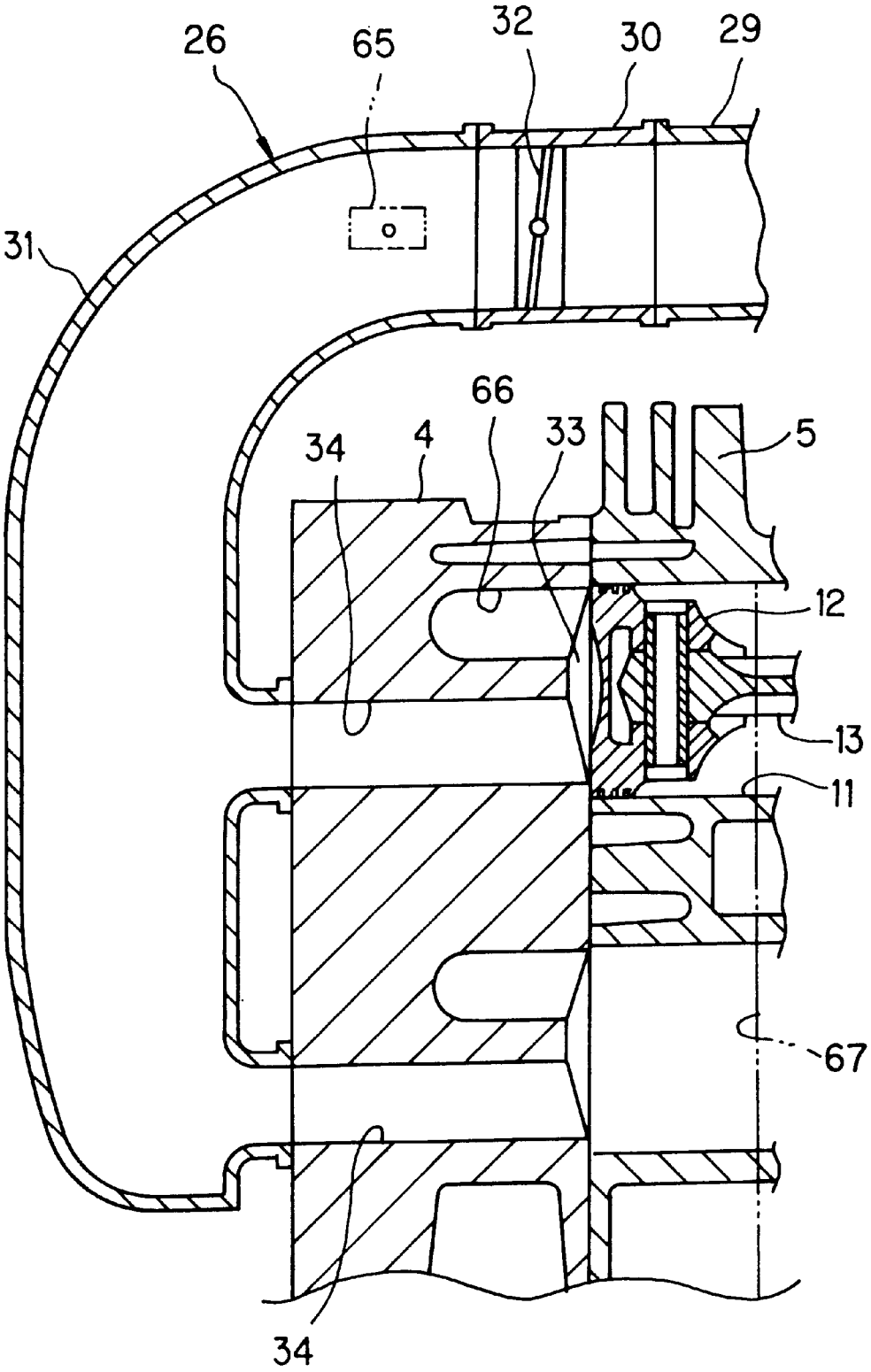
FIG. 3 is a cross-sectional view taken along the line III—III in FIG. 2.

FIG. 3 is a cross-sectional view taken along the line III—III in FIG. 2, showing a state in which an intake air negative pressure sensor 65 for detecting the inlet negative pressure of the intake air is mounted to the surge tank 31.

A combustion chamber 33 is formed at the connecting portion of the cylinder head 4 and the cylinder block 5, and the combustion chamber 33 is connected to the downstream side of the surge tank 31 by means of an intake port 34 formed in the cylinder head 4 and also connected to the upstream side of an exhaust gas passage 67 formed in the cylinder block 5 through an exhaust port 66 formed in the cylinder head 4.

Furthermore, a valve gear (valve moving mechanism) 38 composed of a cam shaft 35, an intake valve 36, an exhaust valve 37 and the like is arranged in the cylinder head 4. An ignition plug 39 is connected to the central portion of the combustion chamber 33 by means of a screw from the outside of the cylinder head 4, to which a fuel injector 40 is attached at a portion suitable for injecting the fuel toward the inside of the intake port 34 on the upstream side of the intake valve 36.

As shown in FIG. 1, the exhaust gas passage 67 is formed in the cylinder block 5 so as to extend downward in the engine 2 and penetrate the engine holder 3 and is opened to the drive shaft housing 18. Furthermore, to an intermediate portion of the exhaust gas passage 67, an oxygen ($O_2$) sensor 68 is mounted through a sensor mounting 49 to be freely detachable. The sensor mounting 49 serves also as a mode shift switch and outputs a signal representing "ON" state of the oxygen feedback mode to a control unit 48, which is described hereinlater, in a state where the $O_2$ sensor 68 is mounted to the sensor mounting 49.

Figure 4:
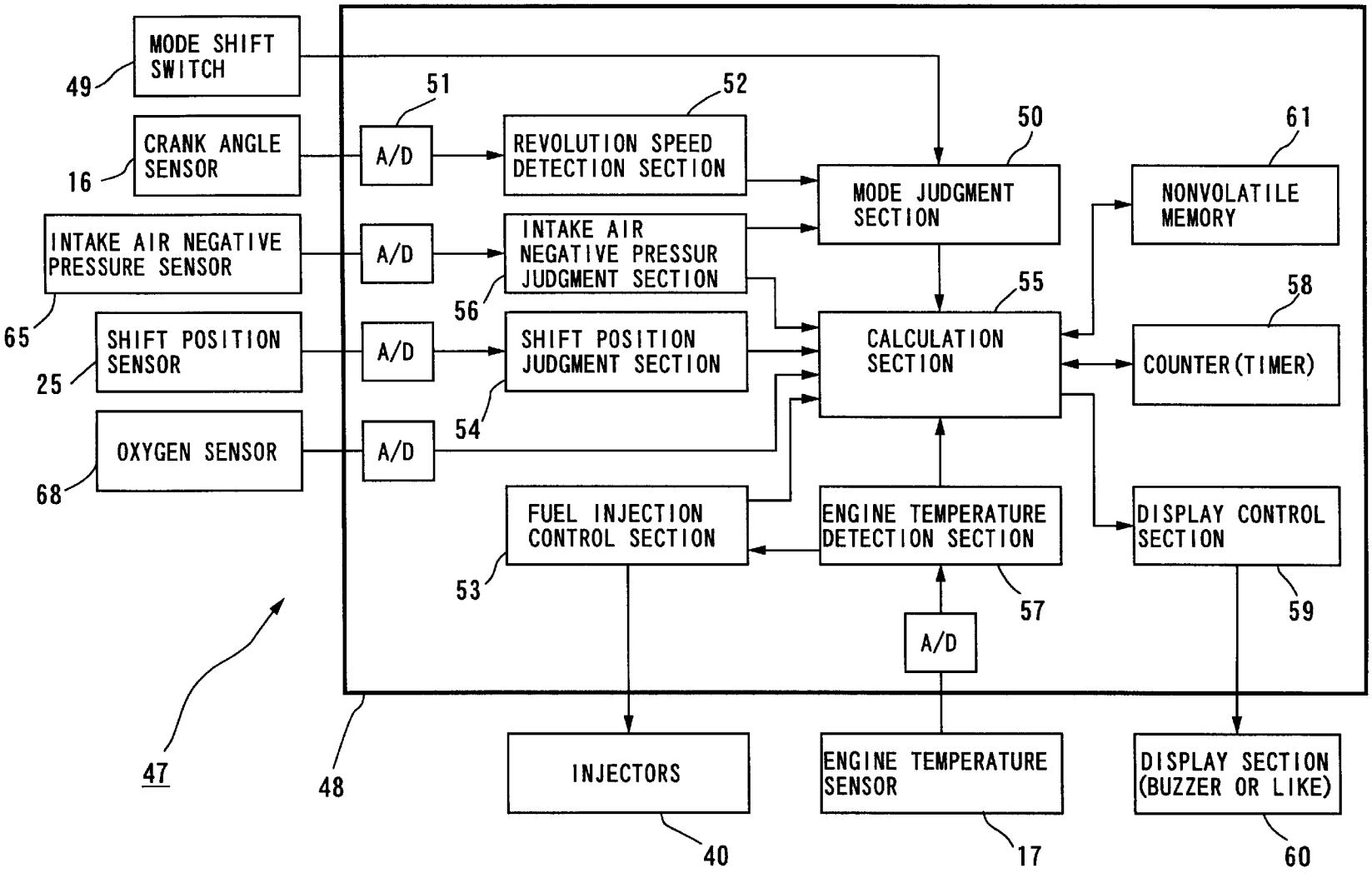
FIG. 4 is a block diagram of a control unit having an air-fuel ratio control device.

FIG. 4 is a block diagram of the control unit 48, which is disposed in the engine 2 at a portion not heated and not suffered from noises, i.e. a portion remote from a plug or ignition means, for example, as shown with imaginary lines (two-dot-chain lines) in FIGS. 1 and 2, in a manner such that an accommodation box 100 is disposed in a floating state on the side surface of the cylinder block through a rubber mat and the control unit 48 is disposed in this accommodation box.

The control unit 48 comprises an air-fuel ratio control device 47 which detects the state of the exhaust gas by using the $O_2$ sensor 68 and changes the fuel injection quantity or the like, thus controlling the air-fuel ratio according to the operating state of the engine 2 which is detected by another detection means. The control device 47 further performs the feedback control, for example, to keep the state of the exhaust gas and the drivability of the engine in good conditions. As shown in FIG. 4, the air fuel-ratio control device 47 has the mode shift switch 49 mentioned before and detects whether the oxygen sensor 68 is mounted to the sensor mounting 49 or not, that is, whether the feedback control mode is in the "ON" state or not, end then outputs the data to a mode judgment section 50 in the control unit 48.

Furthermore, the rotational angle of the crank shaft 10 detected by the crank angle sensor 16 is sent to a revolution speed detection section 52 in the control unit 48 through an A/D (analog-to-digital) converter 51 for converting an analog signal into a digital signal to obtain the revolution speed of the engine 2, and the data is output to a calculation section 55 in the control unit 48.

Furthermore, the shift position of the clutch device 23 detected by the shift position sensor 25 is sent to a shift position judgment section 54 in the control unit 48 through the A/D converter 51 to judge the shift position of the clutch device 23. The thus obtained data is then output to the calculation section 55.

Moreover, the intake air negative pressure detected by the intake air negative pressure sensor 65 is sent to an intake air negative pressure judgment section 56 in the control unit 48 through the A/D converter 51 to judge the inlet negative pressure of the intake air in the surge tank 31, and the obtained data is output to the calculation section 55 in the control unit 48.

Then, the quantity of oxygen in the exhaust gas detected by the oxygen sensor 68 is input into the calculation section 55 in the control unit 48 through the A/D converter 51.

Finally, the wall temperature of the engine 2 detected by the engine temperature sensor 17, that is, a signal representing the engine temperature is sent to an engine temperature detection section 57 in the control unit 48 through the A/D converter 51 to obtain the wall temperature of the engine 2. The thus obtained data is output to the calculation section 55 in the control unit 48.

A fuel injection control section 53 is further arranged in the control unit 48. The proper fuel injection quantity is calculated in accordance with the engine revolution speed (i.e. crank angle) and the shift position of the clutch device 23, the pressure of the intake air negative pressure, the engine temperature and the quantity of oxygen in the exhaust gas which are input into the calculation section 55. The thus obtained data is output to the fuel injection control section 53, which then operates each fuel injector 40 on the basis of the data so as to inject a proper amount of fuel into the intake port 34. Furthermore, the fuel injection quantity obtained by the fuel injection control section 53 in this operation is fed back to the calculation section 55 to be used for the calculation of the fuel injection quantity.

Figure 5:
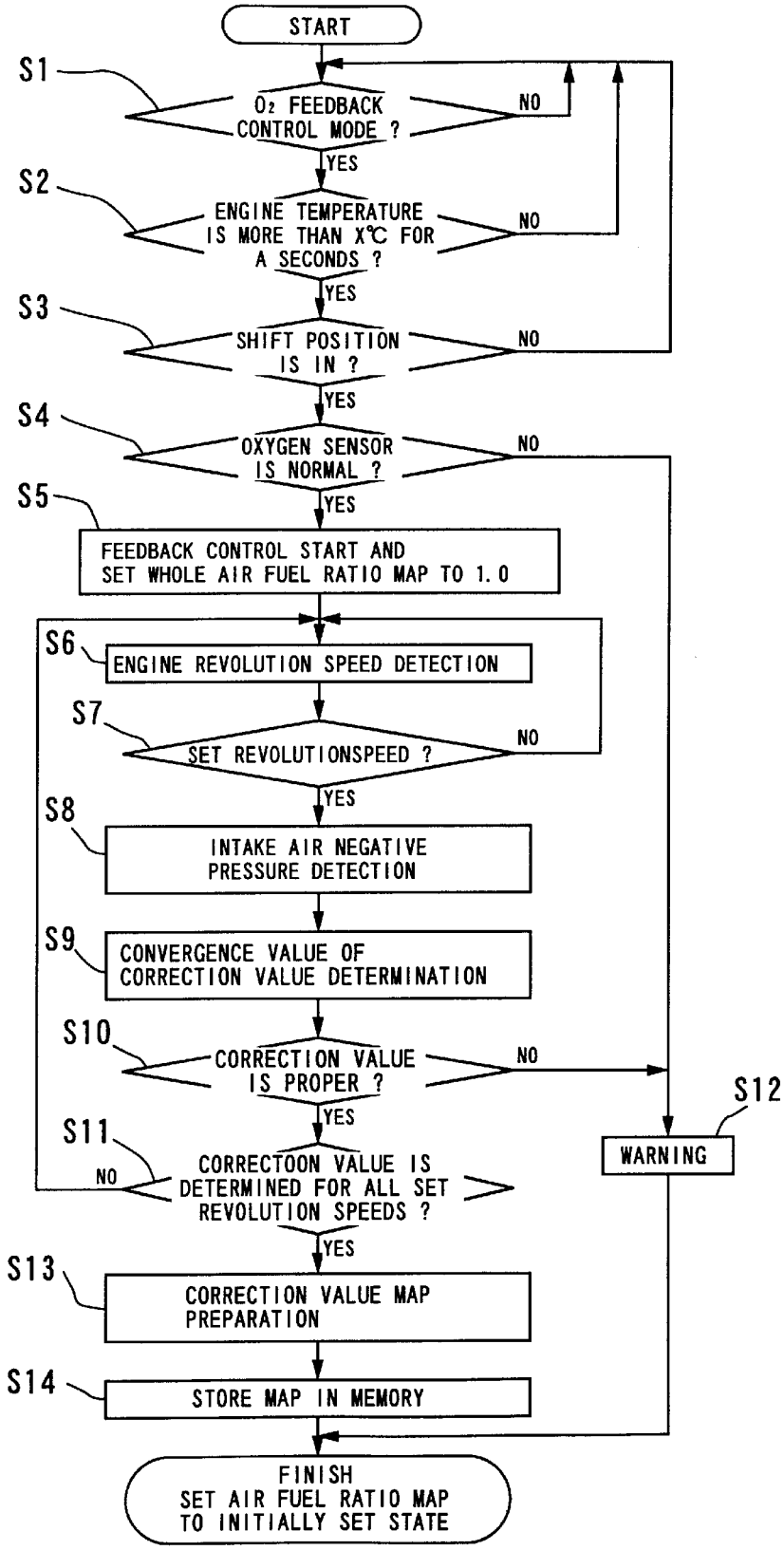
FIG. 5 is a flowchart representing a flow of the first embodiment for calculating a fuel injection quantity performed by a calculation unit.

FIG. 5 is a flowchart showing the flow of the first mode for calculating the fuel injection quantity performed by the calculation section 55.

Referring to FIG. 5, at the first step S1, after the start of the engine 2, it is judged whether the oxygen sensor 68 is mounted to the sensor mounting 49 or not, that is, whether the mode is the $O_2$ feedback control mode or not.

If the mode is judged to be the $O_2$ feedback control mode, at the next step S2, it is judged whether the engine temperature (wall temperature of the engine 2) is equal to or greater than a specified temperature (X° C.) for a specified time (for A seconds) or less than a specified temperature (X° C.) for confirming the warming up of the engine 2. Furthermore, the control unit 48 is provided with a counter (timer) 58 for measuring the elapsed time.

If the warning up of the engine 2 is confirmed, at the next step S3, it is judged whether the shift position is in the "IN" state or not for confirming the state of loads given to the engine 2. In this time, if the judgment is "NO" at either one of the above mentioned steps S1 to S3, the $O_2$ feedback control is not performed.

If the judgement is "YES" in all the steps S1 to S3, the $O_2$ feedback control is judged to be performed and at the next step S4, it is judged whether the $O_2$ sensor 68 is normal or not, that is, whether the $O_2$ sensor 68 is active or not. If it is judged that the $O_2$ sensor 68 is not normal, a display section 60 such as a light-emitting diode (LED) or a buzzer is operated through a display control section 59 installed in the control unit 48 and a warning for urging an operator to check or exchange the $O_2$ sensor 68 is issued (step S12).

If the $O_2$ sensor 68 is judged to be normal, the feedback control is started. It is also possible at this time that all values of the air-fuel ratio map are temporarily set to 1.0 so that the air-fuel ratio may be the theoretical air-fuel ratio in all areas (step S5), though mentioned herein later. In the feedback control process, the revolution speed of the engine 2 is first detected at the step S6, and it is judged whether the revolution speed is the same as the previously determined set revolution speed or not (step S7). If the engine revolution speed is different from the set revolution speed, the steps S6 and S7 are repeated until they become the same value. Although a plurality of set revolution speeds may be provided, the comparison with the revolution speed of the engine 2 should be performed for one at a time.

Figure 6:
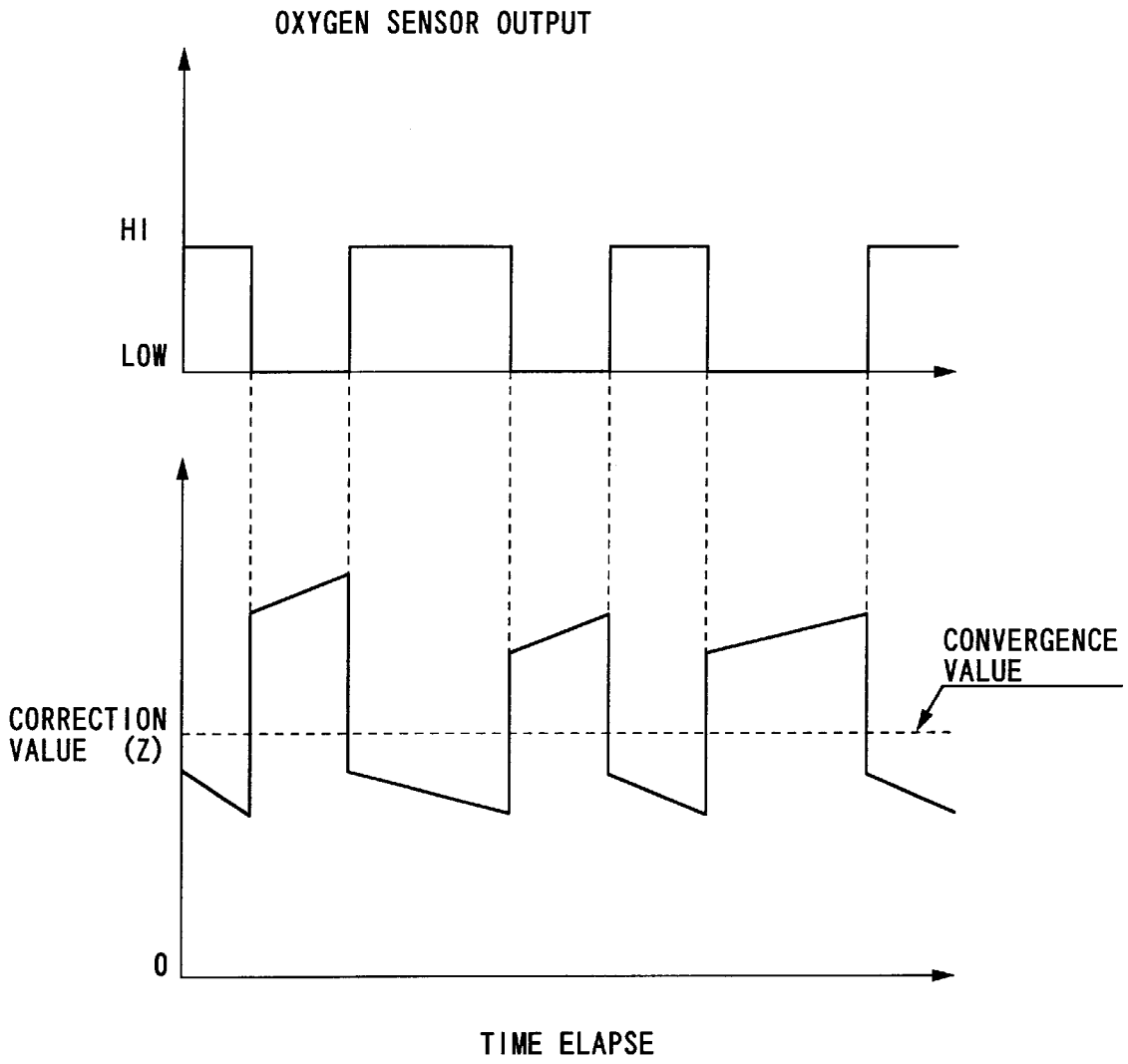
FIG. 6 is a graph showing a convergence value of a correction value of the fuel injection quantity.

If the engine revolution speed is judged to be the same as the set revolution speed, the intake air negative pressure is detected (step S8), and on the basis of the data obtained (such as the engine revolution speed or the intake air negative pressure), the fuel injection quantity is calculated. As shown in FIG. 6, as the correction value (Z) of the fuel injection quantity, the convergence value is determined in response to the output from the $O_2$ sensor 68 in the step S9.

When the convergence value of the correction value is determined, it is judged whether a newly set correction value is proper or not (step S10). For example, if the correction value exceeds a previously set certain range, it is judged that the newly set correction value is not proper, and a warning is issued immediately (step S12) to urge the operator to check the engine 2, whereas if the newly set correction value is judged to be proper and a plurality of set revolution speeds are provided, at the next step (step S11), it is judged whether the correction values are obtained at all the set revolution speeds or not. In this step, if the correction values are not obtained at all the set revolution speeds, it is required to return to the step S6, and the correction values at other set revolution speeds are determined.

When the correction values are obtained at all the set revolution speeds, a correction value map is prepared on the basis of these correction values (step S13), and this map is stored in a nonvolatile memory 61 installed in the control unit 48 (step S14). Then, the injection quantity of fuel is controlled on the basis of this stored correction value map. Then, if all values of the air-fuel ratio map are set to 1.0 at the starting time of the feedback control, the air-fuel ratio map is made to be in the initial set state at the finish time of the feedback control.

Further, it may be possible that the display section 60 such as an LED or a buzzer is operated through the display control section 59 to inform of the fact to the operator at the time of the end (finish) of each step, for example, at the time of start of the feedback control, at the time of determining the correction value of the set revolution speeds (only the number of set revolution speeds), or at the time of finish of the feedback control.

Figure 7:
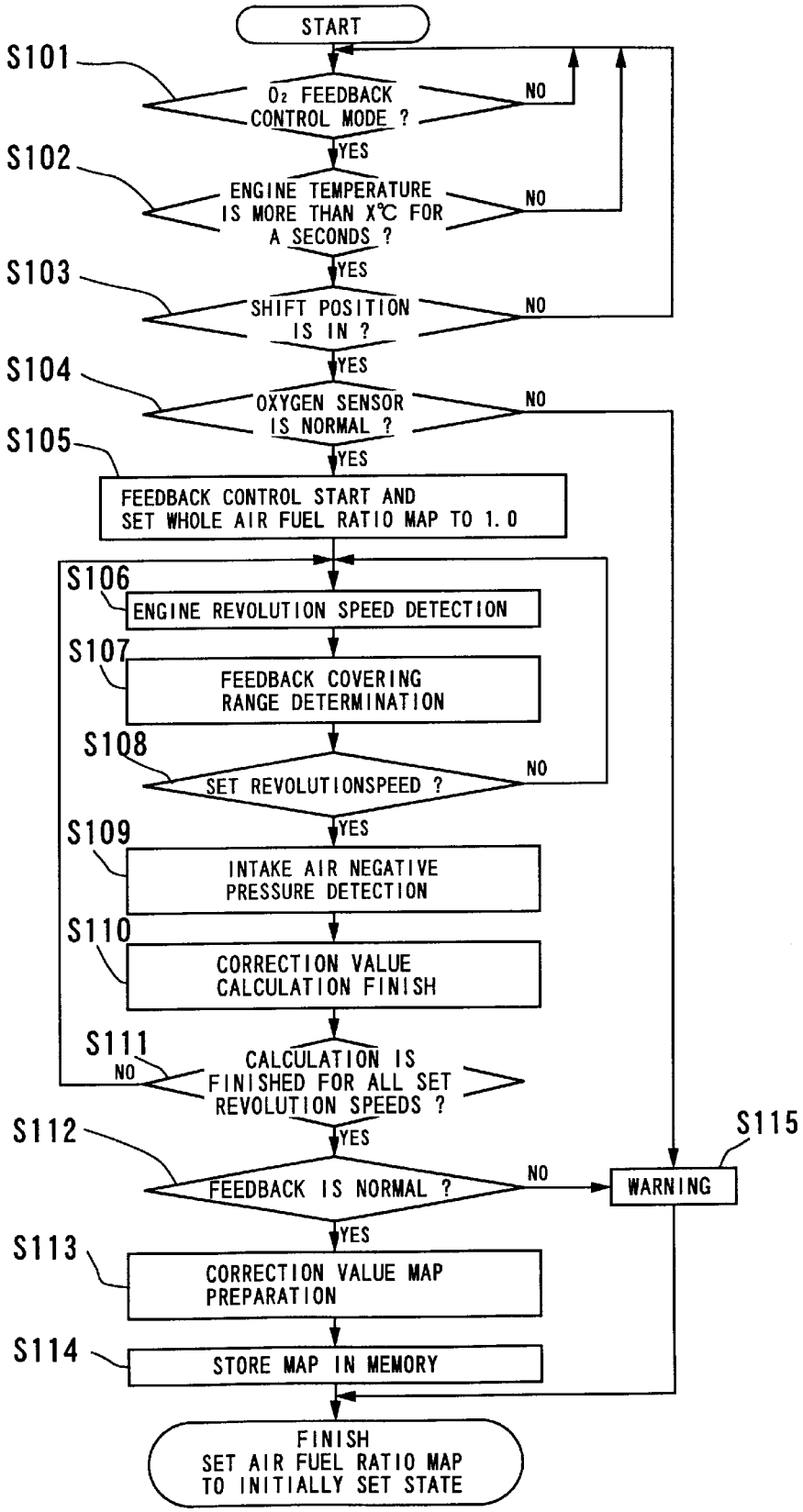
FIG. 7 is a flowchart representing a flow of the second embodiment for calculating the fuel injection quantity performed by the calculation unit.

FIG. 7 is a flowchart representing the flow of the second mode for calculating the fuel injection quantity performed by the calculation section 55. Referring to FIG. 7, it is first to be noted that the steps in flow up to the step S106, where the revolution speed of the engine 2 is detected, are the same as the steps S1 S6 of the first mode of FIG. 5 described above, so that the description thereof is omitted here.

When the revolution speed of the engine 2 is detected, a covering range of the feedback is determined in the step S107. As an example of determination of the covering range of the feedback, for instance, as shown by the correction value map in FIG. 8, the correction values (zones) $Z_3$, $Z_6$, $Z_9$ are covered when Ne (revolution speed of the engine 2) is N3≧Ne>N2, and when Ne is N2≧Ne>N1, the correction values $Z_6$ and $Z_9$ are covered, and further, when Ne is Ne≧N1, the $_9$ is covered.

When the covering range of the feedback is determined, next, similarly to the first mode, it is judged whether the revolution speed of the engine 2 is the same as the previously determined set revolution speed or not (Step 108), and if the engine revolution speed is different from the set revolution speed, the steps S106, 107 and 108 are repeated until they become the same value. Furthermore, a plurality of set evolution speeds can be provided similarly to the first mode. Moreover, the set revolution speed may be an optional stable revolution speed in the determined range.

When the engine revolution speed is judged to be the same as the set revolution speed, the intake air negative pressure is detected (step S109), and the correction value of the fuel injection quantity is calculated on the basis of the data obtained (engine revolution speed, output of the $O_2$ sensor 68, intake air negative pressure, and the like) (step S110). Meanwhile, it is not judged, in this second mode, whether the correction value is proper or not, though it is judged in the first mode of FIG. 5.

In a case where the correction value of the fuel injection quantity is calculated and a plurality of set revolution speeds are provided, in the next step (step S111), it is judged whether the calculation is performed at all the set revolution speeds. If the calculation is not performed at all the set revolution speeds, the operation returns to the step S106 and the calculation of the correction values at the other set revolution speeds is performed.

If the calculation of the correction values has been performed at all the set revolution speeds, it is judged whether the feedback is normal or not, that is, the result of calculation is normal or not (step S112). If at least either one of the plurality of results of the calculation of the data is normal, the feedback is considered to have succeeded, but if no normal result of calculation is obtained, a warning is issued immediately (step S115) to urge the operator to check the engine 2.

Furthermore, if the feedback is normal, a correction value map is prepared on the basis of the result of calculation (step S113), and this map is stored in the nonvolatile memory 61 in the control unit 48 (step S114). Then, the injection quantity of fuel is controlled on the basis of this stored correction value map. Finally, the air-fuel ratio map is made to be in the initial state at the finish time of the feedback control.

The operation and function of the embodiments (control modes) mentioned above will be further described hereunder.

Since the $O_2$ sensor 68 can be arranged on the way of the exhaust gas passage 67 so as to be freely detachable, the $O_2$ sensor 68 is removed and the feedback control of the air-fuel ratio can be not performed at the time of the normal use of the engine 2, and the feedback control is performed temporarily only at the time of a periodic check or at the time of checking the degradation or the bad condition of the engine 2. This process is performed as mentioned above as first and second modes, in which the feedback correction is performed to obtain the convergence value of the correction value as the correction factor. Then, on the basis of the new correction value, a correction value map is prepared, and this map is stored in the nonvolatile memory 61 in the control unit 48, and the injection quantity of fuel is controlled on the basis of the stored correction value map. Consequently, the state of the exhaust gas and the drivability of the engine 2 can be kept in a good condition.

Since the $O_2$ sensor 68 is not used at the time of usual use of the engine and is used only at the time of a check, degradation of the $O_2$ sensor 68 is prevented and a stable air fuel-ratio can be provided. Further, it is not necessary to install the $O_2$ sensor 68 to the engine 2 at all times and it is only necessary to store a required number of $O_2$ sensors 68 at the operation area, so that the costs required for the engine 2 can be reduced.

Furthermore, since it is impossible to produce all the operating conditions of the engine 2 in the market, the correction value map is prepared on the basis of the typical operating conditions among them. Consequently, in some operation areas, the correction is not performed, but in these areas, the correction factor is estimated from the corrected operation areas, so that the correction value may be determined. Furthermore, if a plurality of set revolution speeds are provided as the calculation basis, it is possible to calculate more minute correction values.

As a result, even if the operating area of the engine 2 is an area cut of the feedback control area, the engine 2 can be operated in a state of nearly the most proper air-fuel ratio.

Figure 8:
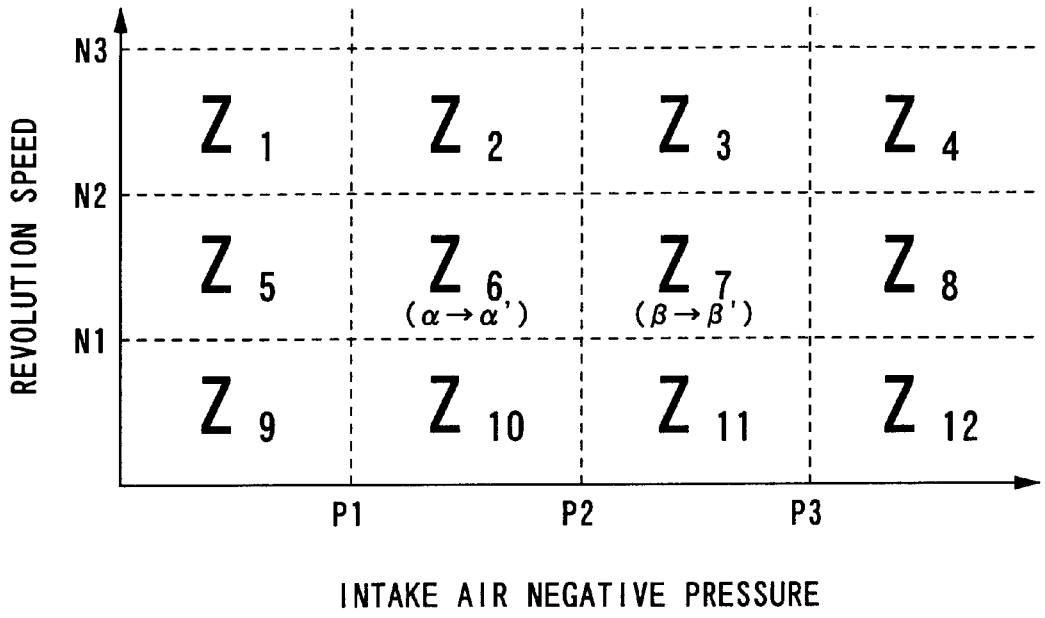
FIG. 8 is a correction value map.
Figure 9:
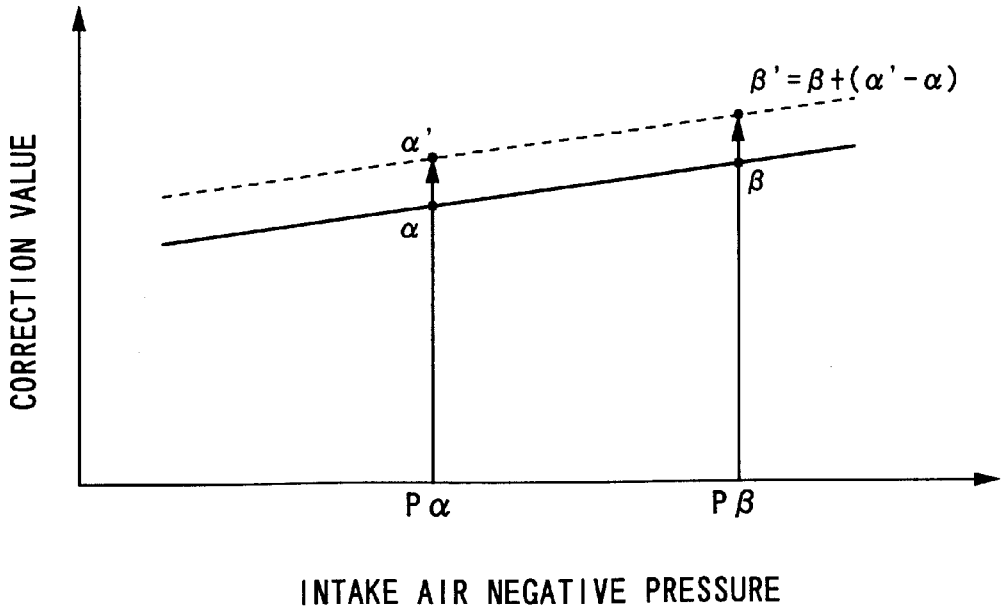
FIG. 9 is a figure showing how to find the correction values in adjacent zones out of feedback areas.

Furthermore, it is also possible that the correction factor is reflected to the adjacent correction zones of the correction value so that the correction value in the range out of the feedback control may be set. Specifically, for example, as shown in FIG. 8, when it is assumed that the last stored correction value at the $Z_6$ in the feedback area is $\alpha$ and the value at the adjacent $Z_7$ out of the feedback area is $\beta$ and the renewed correction value at the $Z_6$ is $\alpha'$, the new correction value $\beta'$ at the $Z_7$ can be obtained by an equation $\beta'=\beta+(\alpha'-\alpha)$ as shown in FIG. 9. Further, as another method to obtain the correction value $\beta'$, an equation $\beta'=\beta\times\alpha'/\alpha$ may also be used (a method to calculate the value by using "ratio").

Furthermore, since the correction values of the air-fuel ratio are stored in the volatile memory 61, the latest correction values which are last stored are maintained even if the connection with a battery, not shown, is separated, so that the performance of the engine 2 can sufficiently be achieved at all times.

Furthermore, since the feedback is temporary in the above mentioned modes, all the values of the air-fuel ratio map are temporarily set to 1.0 at the starting time of the feedback control to set the air-fuel ratio at the theoretical air-fuel ratio in all areas, and at the finishing time of the feedback control, the air-fuel ratio map is returned to be in the initial set state, so that the initially set air-fuel ratio map can be used at the time of normal operation.

Still furthermore, if an LED, a buzzer or the like is operated at the finishing (end) of each step for the operator, he can easily perform the works at the time of practice of the feedback control without requiring any special tools.

Further, in the above mentioned second mode, if at least one calculation result in a zone is normal among a plurality of calculation results of the data when judging whether the calculation results of the correction value are right or wrong, the feedback is considered to have been successful. The reason is that the feedback operation may or may not be performed in all three zones (for example, $Z_3$, $Z_6$, $Z_9$) divided by the revolution speed, depending on the situation at the time of practice of the feedback operation, and consequently, there are cases where the feedback operation cannot be successfully performed in all zones. However, an arrangement can be made such that the feedback operation does not come to an end until it has successfully been performed in all zones.

Since the feedback is considered to have been successful if a calculation result in one zone is normal, the correction does not become impossible even if the feedback correction is performed under some limited conditions.

On the other hand, in a case where the $O_2$ sensor 68 complains of an abnormality in the course of the feedback operation, or the newly set correction value is judged to be not proper, a warning can immediately be issued to urge the operator to check the engine 2, and after this warning, the data of the correction value are cleared, so that the abnormal data can be prevented from taking in.

As mentioned above, according to the preferred control modes of the present invention, the feedback control mode for detecting the state of the exhaust gas by using the oxygen sensor is set, and correction values of the air fuel ratio are determined by operating the engine in a part of areas of a plurality of operating areas divided in accordance with the revolution speed, the loads and the like of the engine. On the basis of the correction values, correction values of the air-fuel ratio in other operating areas are calculated, and consequently, a proper air-fuel ratio can be kept while preventing the degradation of the oxygen sensor. Thus, the accuracy in correction of the air-fuel ratio is improved.

What is claimed is:

1. A method of controlling an air-fuel ratio in an engine provided with an air-fuel ratio control means, comprising the steps of:

temporarily attaching an oxygen sensor to a sensor mounting positioned in an exhaust gas passage formed in the engine in operative association with the air-fuel ratio control means, wherein the sensor mounting acts as a feedback mode shift switch, the feedback mode switching to "ON" when the oxygen sensor is attached to the sensor mounting and switching to "OFF" when the oxygen sensor is detached from the sensor mounting;

setting a feedback control mode for detecting states of the exhaust gas by using the oxygen sensor;

operating the engine in one of a plurality of operating areas which are sectioned in accordance with engine operational conditions;

determining a first correction value of the air-fuel ratio in accordance with the engine operation with respect to a preliminary set value; and calculating a second correction value of the air-fuel ratio in another operating area on the basis of the first correction value determined.

2. An engine air-fuel ratio control method according to claim 1, wherein the first correction value is determined by operating the engine in different operating areas which are sectioned by the operational condition of revolution speed of the engine.

3. An engine air-fuel ratio control method according to claim 1, wherein the first correction value is determined by operating the engine in different operating areas which are section by the operational condition of an engine intake load.

4. An engine air-fuel ratio control method according to claim 1, wherein a detected revolution speed of the engine is compared to a previously determined set revolution speed, and wherein the revolution speed is set when the two values are equal.

5. An engine air-fuel ratio control method according to claim 1, wherein an air-fuel ratio map is prepared at respective operating areas at the time of the engine feedback control and a value of the air-fuel ratio map is temporarily set to be theoretical air-fuel ratio at the time of the feedback control.

6. An engine air-fuel ratio control method according to claim 1, wherein the feedback control mode begins when it is determined that the oxygen sensor is normally operated.

7. An engine air-fuel ratio control method according to claim 1, wherein the first correction value is concerned with a fuel injection amount which is determined by the engine operational condition.

8. An engine air-fuel ratio control method according to claim 1, wherein the oxygen sensor is removed from the sensor mounting after the air-fuel ratio has been satisfactorily adjusted.

9. An engine air-fuel ratio control method according to claim 1, further including outputting a signal from the sensor mounting when the oxygen sensor is mounted to initiate the feedback control mode.

10. A system for controlling an air-fuel ratio of an engine comprising:

an air-fuel ratio control means disposed in association with the engine;

an oxygen sensor removably attached to a sensor mounting disposed in an exhaust gas passage formed in the engine in operative association with the air-fuel ratio control means;

means for setting a feedback control mode for detecting states of the exhaust gas by using the oxygen sensor;

means for operating the engine in one of a plurality of operating areas which are sectioned in accordance with an engine operational conditions;

means for determining a first correction value of the air-fuel ratio in accordance with the engine operation with respect to a preliminary set value; and means for calculating a second correction value of the air-fuel ratio in another operating area on the basis of the first correction value calculated by the correction value determining means.

11. A system for controlling an air-fuel ratio of an engine according to claim 8, wherein the first correction value is determined by operating the engine in different operating areas which are sectioned by the operational condition of revolution speed of the engine.

12. A system for controlling an air-fuel ratio of an engine according to claim 10, wherein the sensor mounting is a mode shift switch for outputting a signal representing an "ON" state of the oxygen feedback mode when the oxygen sensor is mounted.

* * * * *